US010792933B1

(12) United States Patent
Forbes

(10) Patent No.: US 10,792,933 B1
(45) Date of Patent: Oct. 6, 2020

(54) APPARATUS FOR OPENING AND PRINTING INDICIA UPON ENVELOPES

(71) Applicant: John Forbes, Stratford, NJ (US)

(72) Inventor: John Forbes, Stratford, NJ (US)

(73) Assignee: OPEX Corporation, Moorestown, NJ (US)

( * ) Notice: Subject to any disclaimer, the term of this patent is extended or adjusted under 35 U.S.C. 154(b) by 0 days.

(21) Appl. No.: 16/362,103

(22) Filed: Mar. 22, 2019

(51) Int. Cl.
*B41J 3/28* (2006.01)
*B43M 7/00* (2006.01)

(52) U.S. Cl.
CPC ..... *B41J 3/28* (2013.01); *B43M 7/007* (2013.01)

(58) Field of Classification Search
CPC ..... B41J 3/28
See application file for complete search history.

(56) References Cited

U.S. PATENT DOCUMENTS

| | | | |
|---|---|---|---|
| 3,943,807 | A | 3/1976 | Bingham et al. |
| 4,216,480 | A | 5/1980 | Buehner et al. |
| 4,576,287 | A | 3/1986 | Bingham et al. |
| 4,867,437 | A | 9/1989 | Wise |
| 5,156,515 | A | 10/1992 | Charron et al. |
| 5,443,253 | A | 8/1995 | Dale et al. |
| 5,470,182 | A | 11/1995 | Krupotich et al. |
| D422,874 | S | 4/2000 | Forbes |
| 6,065,830 | A | 5/2000 | Hiramatsu et al. |
| 6,547,078 | B1 | 4/2003 | Lile et al. |
| D478,121 | S | 8/2003 | Forbes |
| 6,612,211 | B1 | 9/2003 | Stigliano et al. |
| 6,912,827 | B2 | 7/2005 | Forbes |
| 8,919,084 | B2 | 12/2014 | Allen et al. |
| 8,919,570 | B2 | 12/2014 | DeWitt et al. |
| 9,527,114 | B2 | 12/2016 | DeWitt et al. |
| 2002/0126305 | A1 | 9/2002 | Keithly et al. |
| 2007/0059069 | A1 | 3/2007 | Ishizuka |
| 2015/0114890 | A1 | 4/2015 | Helmlinger et al. |

FOREIGN PATENT DOCUMENTS

| | | |
|---|---|---|
| JP | H11235834 | 8/1999 |

OTHER PUBLICATIONS

Omation—Model 106 Envelopener with Unique Milling Cutter, product brochure, published before Apr. 2012.
Omation—Model 202C Envelopener, product brochure, published before Apr. 2012.

(Continued)

*Primary Examiner* — Julian D Huffman
(74) *Attorney, Agent, or Firm* — Stephen H. Eland

(57) ABSTRACT

An apparatus includes an input bin for receiving a stack of envelopes, a conveyor for conveying each envelope of the stack along an envelope path, and a cartridge retainer adapted for electrical connection to an inkjet cartridge defining a 1×M array of inkjet printing nozzles. The apparatus further includes a controller electrically coupled to the cartridge retainer and configured to activate the inkjet cartridge nozzles to deposit ink droplets according to a predetermined duty cycle able to cause printing, on an envelope conveyed at a first feed rate, a first indicium having a density of M×N dots per inch, where N is greater than M/2 and less than M. The conveyor, however, conveys envelopes faster than the first feed rate, whereby the first indicium is printed at a density of less than M×N dots per inch on a moving envelopes.

22 Claims, 5 Drawing Sheets

(56) References Cited

OTHER PUBLICATIONS

Omation—Model 2000 Table Top Envelopener with Unique Milling Cutter, product brochure, published before Apr. 2012.
Omation—Model EV-2 SorterNerifier, product brochure, published before Apr. 2012.
International Search Report issued in PCT Application No. PCT/US20/24197 dated Jun. 22, 2020.

APPARATUS FOR OPENING AND PRINTING INDICIA UPON ENVELOPES

FIELD OF THE INVENTION

The present invention relates to the field of processing mail. More specifically, the present invention relates to a workstation operable to process envelopes containing contents by presenting opened envelopes to an operator so the operator can extract the contents from the envelopes.

BACKGROUND

Automated and semi-automated machines have been employed for processing mail. One such device is an envelope opener that is operable to sever an edge of each piece of mail being processed. In U.S. Pat. No. 8,919,570 entitled APPARATUS FOR OPENING AND SORTING ENVELOPES and issued to DeWitt et al. on Dec. 30, 2014, there is disclosed an envelope opener having an input bin for receiving a stack of mail. Each envelope is fed, from the bottom of the stack, onto a conveyor which transports the envelope to a cutting device. After the cutting device severs an edge of an envelope, the envelope is delivered one of several sort destinations according to a determination made by a sensor.

The system disclosed by DeWitt et al. provides for the processing of incoming mail at levels of efficiency and performance which are high enough to justify a premium in the commercial marketplace. Nonetheless, a continuing demand exists for systems characterized by lower cost and complexity but nonetheless capable of implementing the basic unstacking, conveying and edge severing functions of an envelope opener. In accordance with the present invention, an envelope opening apparatus and method are provided for processing a batch of mail containing envelopes having a range of thicknesses, in accordance with the basic functions of an envelope opener, wherein the processing further includes printing indicia upon at least some of the envelopes as they are conveyed.

SUMMARY OF THE INVENTION

The present invention provides an envelope opening apparatus of reduced complexity but nonetheless capable of unstacking, printing indicia upon and, optionally, opening envelopes at a rate able to address a significant segment of the commercial, incoming mail processing market.

In an embodiment, an apparatus for opening and printing indicia upon envelopes containing contents comprises: an input bin dimensioned and arranged to receive and support a stack of envelopes; a conveyor for forwardly conveying each envelope of the stack along an envelope path toward a discharge; a cutter positioned along the envelope path operable to sever an edge of each envelope forwardly conveyed by the conveyor; an inkjet cartridge retainer having electrical contacts for providing electrical connectivity to an inkjet cartridge defining a 1×M array of inkjet printing nozzles, the inkjet cartridge retainer being dimensioned and arranged to retain the inkjet cartridge in an orientation permitting ink droplets to be ejected onto an envelope being forwardly conveyed along the envelope path; and a controller electrically coupled to the electrical contacts of the inkjet cartridge retainer. The controller is configured to activate the inkjet printing nozzles of a retained inkjet cartridge to deposit ink droplets according to a predetermined duty cycle able to cause printing, on an envelope conveyed at a first feed rate, a first indicium having a resolution of M dots per inch in a first direction transverse to the envelope path and a resolution of N dots per inch in a second direction parallel to the envelope path, where N is an integer less than or equal to M. However, the conveyor is configured to convey envelopes at a second feed rate greater than the first feed rate, whereby deposition of ink droplets onto a forwardly conveyed envelope results in printing the first indicium with a resolution of M dots per inch in the first direction and less than N dots per inch in the second direction.

In some embodiments, the apparatus includes a lower guide disposed along the envelope path and defining a planar upper surface, the planar upper surface of the first guide being inclined upwardly from a plane of conveyance defined by the conveyor, wherein the lower guide is dimensioned and arranged to lift a region of an advancing envelope to accommodate deposition of ink droplets onto a target surface of the advancing envelope.

In an embodiment, the second feed rate is greater than 78.75 centimeters/second (cm/s), and may be from about 80 to about 165 cm/s. The lower guide is a resilient member adapted to deflect by an amount effective to accommodate fed envelopes having thicknesses in a range of from about 0.25 mm to about 4.8 mm. An upper guide is disposed along the envelope path and aligned with the lower guide, the upper guide defining a first surface portion inclined downwardly in a direction of conveyance to urge each advancing envelope downwardly against the planar upper surface of the lower guide, whereby an upper surface of each advancing envelope transitions into an ink droplet deposition zone.

The upper guide further defines a substantially planar second surface portion extending from the first surface portion, the second surface portion being coplanar with the ink droplet deposition zone. In embodiments, the upper guide further defines an aperture extending along and through at least a portion of the second surface portion, the aperture being dimensioned and arranged to permit ink droplet deposition through the upper guide while an envelope is advanced. Preferably, the upper guide is fabricated from a material sufficiently resilient as to accommodate insertion of an inkjet cartridge into registration with the inkjet cartridge retainer or removal therefrom.

In embodiments, the first indicium is an alphanumeric character and the controller is adapted to apply signals to the electrical contacts of the inkjet cartridge retainer, at selected intervals, to print multiple such alphanumeric characters as each envelope fed from the stack is conveyed by the conveyor. The result of conveying envelopes at a higher feed rate (e.g. 160 cm/s) than contemplated for the predetermined duty cycle of the inkjet printer nozzles (e.g., 78.75 cm/s) results in characters having a noticeably elongated appearance. Where an illustrative alphanumeric character field might have a width which is from about 0.5 to about 0.75 of its height, characters printed in accordance with embodiments of the present disclosure may occupy a field having a width equal to or, in some embodiments, even greater than the height of the field.

Where the processing of incoming mail does not require automated opening at the same time as the printing of an indicium (or of indicia) thereon, the cutting element may be omitted in some embodiments. In one such embodiment, an apparatus for printing indicia upon envelopes containing contents comprises an input bin dimensioned and arranged to receive and support a stack of envelopes; a conveyor for forwardly conveying each envelope of the stack along an envelope path toward a discharge; an inkjet cartridge retainer having electrical contacts for providing electrical connectivity to an inkjet cartridge defining a 1×M array of inkjet printing nozzles, the inkjet cartridge retainer being dimensioned and arranged to retain the inkjet cartridge in an orientation permitting ink droplets to be ejected onto an envelope being forwardly conveyed along the envelope path; and a controller electrically coupled to the electrical contacts of the inkjet cartridge retainer, the controller configured to activate the inkjet printing nozzles of a retained inkjet cartridge to deposit ink droplets according to a predetermined duty cycle able to cause printing, on an envelope conveyed at a first feed rate, a first indicium having a resolution of M dots per inch in a first direction transverse to the envelope path and a resolution of N dots per inch in a second direction parallel to the envelope path, where N is an integer less than or equal to M. However, the conveyor is configured to convey envelopes at a second feed rate greater than the first feed rate, whereby deposition of ink droplets onto a forwardly conveyed envelope results in printing the first indicium with a resolution of M dots per inch in the first direction and less than N dots per inch in the second direction.

A method for processing envelopes containing contents comprises the steps of providing a stack of envelopes containing contents; conveying a first envelope from the stack along an envelope path, the conveying including transporting the envelope at a second feed rate greater than a first feed rate; operating a controller to activate selected inkjet printing nozzles of a 1×M array of inkjet printing nozzles defined by an inkjet cartridge, the inkjet printing nozzles being activated according to a predetermined duty cycle able to cause printing, on an envelope conveyed at the first feed rate, a first indicium having a resolution of M dots per inch in a first direction transverse to the envelope path and a resolution of N dots per inch in a second direction parallel to the envelope path, where N is an integer less than or equal to M; and conveying the first envelope at the second feed rate during the operating whereby deposition of ink droplets onto a forwardly conveyed envelope results in printing the first indicium with a resolution of M dots per inch in the first direction and less than N dots per inch in the second direction. The operating comprises activating the inkjet printing nozzles while the inkjet cartridge is stationary.

In some embodiments, the method further includes a step of transporting the first envelope to a cutting element operable to cut a first edge of the first envelope, and the second feed rate is a substantially constant velocity of from about 80 to about 165 cm/s. In an embodiment, the second feed rate is from about 155 to about 165 cm/s.

In an embodiment, the controller is operated repetitively to print multiple alphanumeric characters on the first envelope during the conveying. Subsequent envelopes may be processed according to the same method as for the first envelope. Where no indicia is required to be printed for a particular envelope, the step of controlling the inkjet printer nozzles is omitted.

DESCRIPTION OF THE DRAWINGS

The foregoing summary as well as the following detailed description of the preferred embodiment of the present invention will be better understood when read in conjunction with the appended drawings, in which.

DETAILED DESCRIPTION OF THE PREFERRED EMBODIMENT

Figure 1:
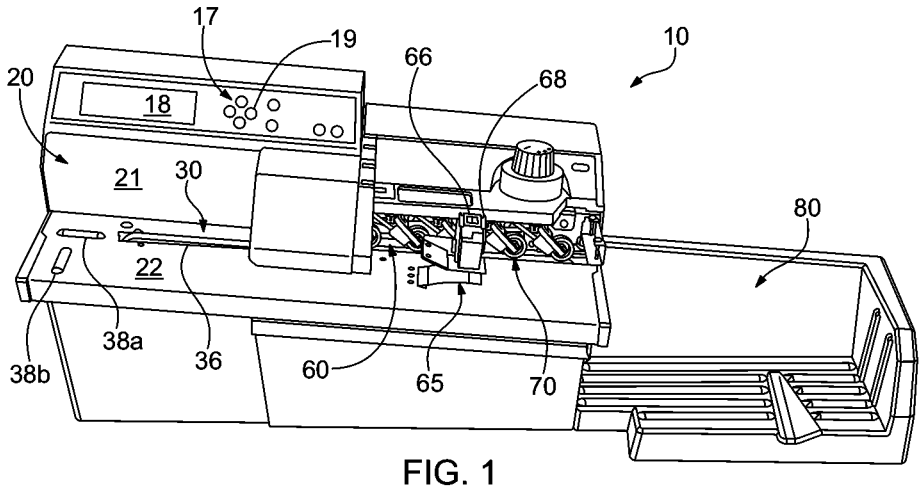
FIG. 1 is a front perspective view of an apparatus for opening envelopes according to the present invention.

Significant commercial demand exists for systems which are characterized by lower cost and complexity but which are nonetheless capable of implementing the basic unstacking, conveying and edge severing functions of an envelope opener. Examples of such systems include U.S. Pat. No. 6,612,211 issued on Sep. 2, 2003 to Stigliano et al. and assigned to OPEX Corporation of Moorestown, N.J., the assignee of the present patent application. Basic envelope opening systems of the type disclosed by Stigliano et al. are capable of unstacking, feeding, transporting and opening envelopes, for subsequent removal of their contents, and they easily achieve envelope transport rates which approach or exceed 158 centimeters per second (cm/s). Inkjet cartridges capable of printing on such fast moving substrates—without introducing discernible amounts of distortion or dot displacement—do exist, but they are so expensive that their use has been limited to such complex and higher-end machines as the one disclosed in the aforementioned U.S. Pat. No. 8,919,570 to DeWitt et al, also assigned to the assignee of the present patent application. The high performance inkjet cartridges require multiple arrays of inkjet printer nozzles, complex driving circuitry, and other adaptations intended to minimize distortion and produce alphanumeric characters and other indicia consistent with the expectation of a consumer purchasing an expensive incoming mail processing system.

Lower duty cycle inkjet cartridges are also available. For example, Hewlett-Packard of Palo Alto, Calif. produces a thermal inkjet cartridge C6602A that is characterized by a single (1×12) array of nozzles which, when activated by a controller according its recommended duty cycle, is able to print standard alphanumeric characters to a resolution of 12×8 (96) dots per inch (dpi) to the surface of a substrate that is moving at about 78.75 cm/s and positioned 1 mm+/−0.5 mm from the nozzle orifices. The inventor herein has discovered that even at substantially higher rates of relative movement between substrate and inkjet print nozzles, it is possible to produce recognizable alphanumeric characters and other indicia using a low duty cycle inkjet cartridges such as the HP C6602A.

The result of conveying the substrate at a higher feed rate than contemplated for the predetermined duty cycle of the inkjet printer nozzles results in characters having a noticeably elongated appearance. Where an illustrative alphanumeric character field might have a width which is from about 0.5 to about 0.75 of its height, for example, characters printed in accordance with embodiments of the present disclosure may occupy a field having a width equal to or, in some embodiments, even greater than the height of the field. Unexpectedly, the characters so-produced are nonetheless clearly distinguishable from one another, legible, and are therefore deemed ideally suitable for application to incoming mail processing systems. Accordingly, embodiments of an apparatus for opening and printing indicia upon envelopes containing contents consistent with the present invention comprise an input bin dimensioned and arranged to receive and support a stack of envelopes; a conveyor for forwardly conveying each envelope of the stack along an envelope path toward a discharge; a cutter positioned along the envelope path operable to sever an edge of each envelope forwardly conveyed by the conveyor; and an inkjet cartridge retainer having electrical contacts for providing electrical connectivity to an inkjet cartridge defining a 1×M array of inkjet printing nozzles. The inkjet cartridge retainer is dimensioned and arranged to retain the inkjet cartridge in an orientation permitting ink droplets to be ejected onto an envelope being forwardly conveyed along the envelope path, and the apparatus further includes a controller electrically coupled to the electrical contacts of the inkjet cartridge retainer.

In embodiments, the controller is configured to activate the inkjet printing nozzles of a retained inkjet cartridge to deposit ink droplets according to a predetermined duty cycle able to cause printing, on an envelope conveyed at a first feed rate, a first indicium having a resolution of M dots per inch in a first direction transverse to the envelope path and a resolution of N dots per inch in a second direction parallel to the envelope path, where N is an integer less than or equal to M. The conveyor, however, is configured to convey envelopes at a second feed rate greater than the first feed rate. Deposition of ink droplets onto an envelope forwardly conveyed at the second feed rate results in printing the first indicium with a resolution of M dots per inch in the first direction and less than N dots per inch in the second direction. In some embodiments, the second feed rate is a constant feed rate that is between from about 1.5 times to 2 times the first feed rate, which produces visibly elongated but nonetheless legible alphanumeric characters.

In the case of the commercially available HP C6602A inkjet cartridge described above, operation at the maximum duty cycle recommended by the manufacturer and an envelope feed rate of 78.75 cm/s (31 inches per second) would yield M=144 dots per inch in the direction transverse to the envelope path and N=96 dots per inch in the direction parallel to the envelope path.

Figure 2:
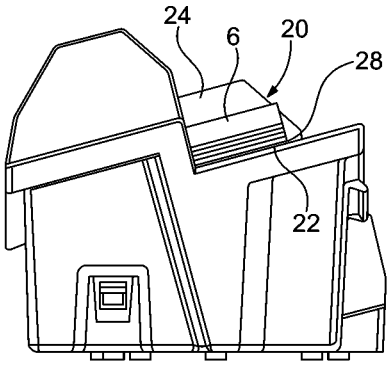
FIG. 2 is a side elevational view of the apparatus illustrated in FIG. 1.

Referring now to the drawings in general, and to FIGS. 1 and 2 specifically, there is shown an illustrative embodiment of an envelope opener 10, consistent with the present disclosure, for opening and printing indicia upon envelopes containing contents. The envelope opener 10 includes an input bin 20 for receiving a stack of unopened envelopes 6. A feeder 30 serially feeds the envelopes from the input bin 20 to an envelope transport 60, which conveys the envelopes along a path. A cutter assembly 70 positioned along the envelope path severs an edge of each envelope as the transport 60 conveys the envelopes. From the cutter, the envelope is conveyed to a discharge area defined by output bin 80, where the opened envelopes accumulate in a generally horizontal orientation to form a stack of opened envelopes (not shown) until they are manually removed by an operator. In an embodiment, the operation of the device is controlled by a control panel 17 having an LCD output screen 18 and a plurality of buttons 19 for manually inputting various operational parameters, such as the number of envelopes to be processed before pausing to allow the operator to remove a stack of opened envelopes from the discharge area defined by output bin 80.

The device 10 is operable to open envelopes of various sizes, including standard-size envelopes, oversized envelopes, commonly referred to as flats, and other large envelopes such as cardboard overnight shipment letter packs. The various envelope sizes need not be sorted by size prior to processing. Instead, a stack of envelopes of similar or varying envelope-size can be processed together. The stack of envelopes 6 is placed into the input bin 20 so that the envelopes form a vertical stack of horizontally disposed envelopes.

Referring to FIG. 1, the input bin 20 of device 10 includes a generally vertical rear wall 21, a side wall 24 (FIG. 2), and a generally planar base plate 22 that also extends under the envelope transport 60. The base plate 22 is generally horizontal, angling downwardly from left to right from the perspective of FIG. 1 and from right to left from the side elevation of FIG. 2. Preferably, the stack of envelopes are edge justified along one of the edges of the stack and the justified edge of the stack is placed in the input bin 20 against the rear wall 21. In addition, the transport 60 is disposed at an angle toward the rear wall 21, so that the transport 60 justifies the envelopes against the rear wall 21. In this way, the transport feeds the envelopes forwardly along the envelope path, and laterally toward rear wall 21.

In embodiments of the disclosure consistent with FIGS. 1 and 2, the input bin 20 includes a pair of elongated ribs 38*a* and 38*b* which are transverse to one another and protrude upwardly from the base plate 22 adjacent the front edge of the base plate 22. Standard sized envelopes lie flat on the base plate 22 between the ribs 38*a* and 38*b* and the rear wall 21. A trailing edge region of oversized mail engages the ribs 38*a* and 38*b* so that the trailing edge region of an oversized envelope rests on the ribs, thereby further angling the oversized envelope toward the rear wall 21 to reduce the possibility of oversized envelopes falling forward out of the input bin.

Referring to FIGS. 1 and 2, the feeder 30 feeds the envelopes from the input bin 20 to the transport 60 one at a time. In an embodiment, the feeder 30 includes a single feed belt 36 that protrudes through the base plate 22 in the input bin 20, confronting the bottom envelope of a stack of envelopes. The side wall 24 of the input bin 20 terminates above the base plate 22 forming a feed slot 28 between the base plate 22 and the bottom edge of the side wall 24.

Figure 3A:
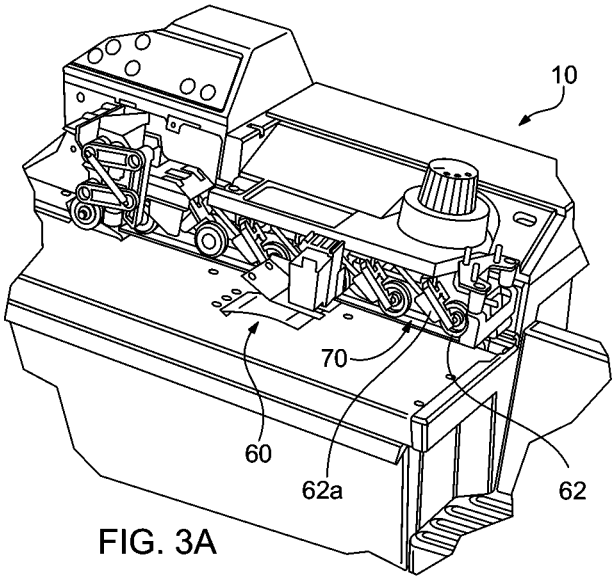
FIGS. 3A and 3B are enlarged fragmentary perspective views of the apparatus illustrated in FIG. 1, depicting inkjet printer and cutter elements according to embodiments consistent with the present disclosure.
Figure 3B:
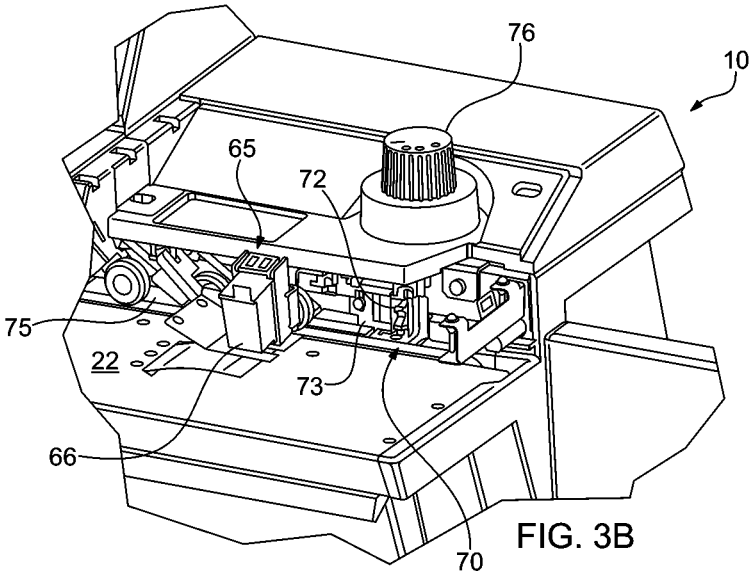

Referring to FIGS. 3A and 3B, it will be seen that the transport 60 conveys each envelope past a cutter assembly 70. In embodiments, the transport 60 comprises a plurality of rollers 62 in an aligned row opposing a transport belt 63. The transport 60 conveys the envelopes between the transport belt 63 and the rollers 62. In this way, the transport 60 conveys the envelopes past the cutter assembly 70 with the envelopes in a generally horizontal orientation rather than a vertical or on-edge orientation. Specifically, the envelopes are face down so that the edges of the envelope are generally in a common horizontal plane rather than the upper edge being above the lower edge as in an on-edge orientation. However, in the present instance, the transport belt 63 is angled toward the plane defined by rear wall 21, similar to the feeder 30, so that the transport belt 63 conveys the envelopes forwardly along the envelope path and laterally toward the plane defined by the rear wall 21.

Each roller 62 of the transport is mounted on a pivotable arm 62*a* positioned vertically above the transport belt 63 so that each roller can pivot toward or away from the transport belt depending on the thickness of the mail piece. Each roller arm is biased downwardly urging the corresponding roller 62 into contact with the transport belt 63. A cover (not shown in the interest of clarity and ease of illustration) partially encloses the rollers to prevent the operator from inadvertently contacting the rollers 62 during operation of the device.

With particular reference to FIG. 3B, it will be seen that the cutter assembly 70 is positioned along the path of the transport 60, and it includes a circular milling cutter 72. The milling cutter 72 rotates about an axis that is generally parallel to the direction of travel of the envelopes as the envelopes pass by the milling cutter. The cutter 72 protrudes through an opening 76 in the back plate of the device 10 and mills the edge of an envelope. Specifically, each tooth of the cutter cuts away segments of an edge of the envelope as the envelope is conveyed past the cutter to produce a feathered edge. As discussed further below, an outfeed guide 73 guides the edge of each envelope to be cut as it approaches the cutter assembly 70.

The edge of each envelope conveyed by the transport is justified against a back plate 75 of device 10. Therefore, the depth of cut of the cutter into the envelope is determined by the distance that the cutter protrudes from the back plate 75. Using a four position rotary knob 76 of cutter assembly 70, the depth of cut can be varied between no cut (fully recessed relative to back plate 75), and three discrete depth adjustments to correspond to the type of envelopes being processed in a particular stack. Such adjustment capability allows device 10 to open a variety of types of envelopes. Turning the knob 76 one way moves the cutter outwardly to one of the three positions to progressively increase the depth of cut. Turning the knob 75 in the opposite direction pivots the cutter inwardly to decrease the depth of cut.

As an envelope approaches the cutter 72, the transport 60 justifies the top edge of the envelope against the back plate 12. As the envelope passes by the cutter 72, the cutter cuts away a portion of the edge of the envelope, which creates a gap above the forward portion of the cut edge of the envelope as it is being cut. Since the transport 60 justifies the envelopes against the back plate as they are being cut, the leading edge of an envelope may skew inwardly toward the back plate as the envelope is being cut, so that the trailing portion of the cut edge may not be properly cut in some instances. Outfeed guide 73 guides and supports the leading portion of the cut edge of an envelope as the envelope is being cut. The outfeed guide 73 projects outwardly from the back plate 75 so that the outfeed guide supports the cut edge of the envelope as it is being cut. Preferably, the outfeed guide 73 projects outwardly from the back plate a distance substantially equal to the depth of cut of the cutter 72.

In embodiments consistent with the present disclosure, the device 10 includes a printer assembly for printing information on the envelopes. In the exemplary embodiment of FIG. 1, device 10 is configured with a finite number of data print instructions from which the user of device 10 can choose. Using buttons 19, the user may scroll through menu options displayed on LCD display 18 and by subsequent button depressions, configure the device 10 to print, for example, a batch number (with each batch number corresponding to a specific group of envelopes processed together), the time at which a particular envelope was processed, the date at which the envelope was processed, or any combination of these. In the embodiment of FIGS. 1 to 7, the printer assembly 65 includes an inkjet printer cartridge 66 mounted above the base plate 22 by an inkjet bracket retainer 68 defining electrical contacts for coupling the inkjet printer cartridge 66 to a controller that activates the inkjet printer nozzles in a manner to be described shortly. The printer 66 is mounted above the base plate to form a gap at least as large as the thickest envelope that is to be processed.

In embodiments, the sensed output of an I/R (infrared) or other sensor is used to detect the leading edge of an advancing envelope as it is conveyed along the envelope path toward the discharge area. In an embodiment, the belt of envelope transport 60 is driven at a constant rate so that the envelopes are conveyed at a known velocity. From this known velocity, and the maximum length of characters to be printed (as defined by selection of the PRINT BATCH, TIME AND DATE menu option described above), the interval over which the printer can be operated to print indicia on each mail piece is derived and stored as a control input to the printer.

Figure 4:
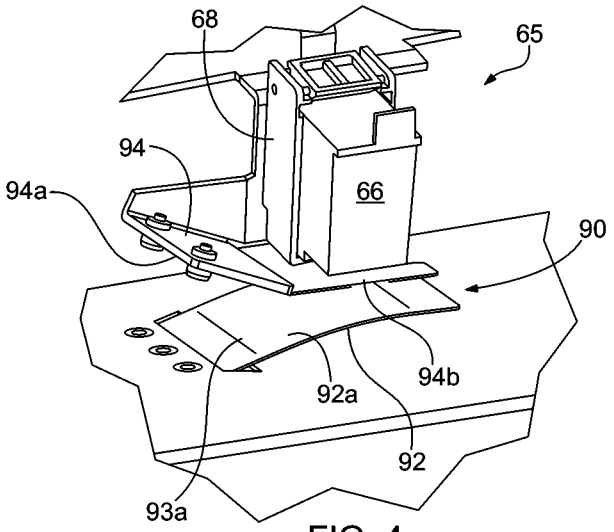
FIG. 4 is an enlarged fragmentary perspective view of the inkjet printer incorporated in the apparatus illustrated in FIGS. 1 and 3.

FIG. 4 is an enlarged fragmentary perspective view of the inkjet printer incorporated in the apparatus illustrated in FIGS. 1, 3A and 3B, FIG. 5 is an enlarged fragmentary side elevation view of the inkjet printer incorporated in the apparatus illustrated in FIGS. 1, 3A and 3B, and FIG. 6 is an enlarged, fragmentary perspective view of the inkjet printer incorporated in the apparatus illustrated in FIGS. 1, 3A and 3B, taken from underneath the upper guide assembly. When using an ink jet printer, it is desirable to have the envelope as close to the printer as possible. However, the device is operable to process envelopes having a wide variety of thicknesses. Accordingly, in the present instance, the device 10 includes a guide assembly 90 that includes a lower guide 92 and an upper guide 94.

With particular reference to FIG. 4, it will be seen that lower (first) guide 92 is disposed along the envelope path and defines a substantially planar upper surface 92*a*, the upper surface 92*a* of the lower guide 92 being inclined upwardly from the upper surface of base plate 22 (FIGS. 1 and 3B). The lower guide 92 is dimensioned and arranged to lift a region of an advancing envelope to accommodate deposition of ink droplets onto a target surface of the advancing envelope. That is, lower guide 92 deflects envelopes upwardly toward the print cartridge 66. The lower guide 92 is a resiliently deformable element that projects upwardly from the base plate 22. For instance, as shown in FIG. 4, the lower guide 92 forms a ramp, angling upwardly from the base plate 22. The forward end 93 of the lower guide 92 bends downwardly to contact the base plate, thereby supporting the forward end of the lower guide 92. The lower guide 92 is resiliently deformable so that the deflector can collapse to accommodate thick envelopes. Configured in this way, lower guide 92 urges the lower edge of the envelope upwardly toward the print cartridge 66 while the upper edge of the envelope is nipped by the envelope transport 60. In a preferred embodiment, the lower guide 92 is a resilient plastic member adapted to deflect by an amount effective to accommodate fed envelopes having thicknesses in a range of from about 0.25 mm to about 4.8 mm.

Figure 5:
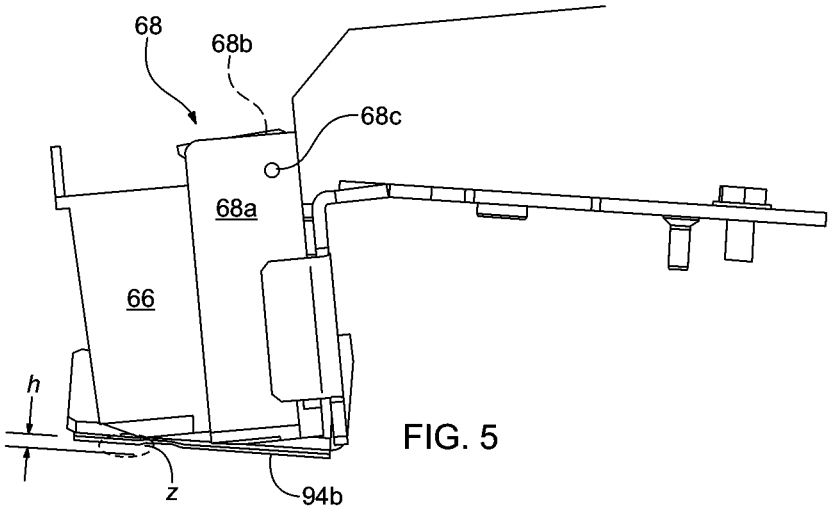
FIG. 5 is an enlarged fragmentary side elevation view of the inkjet printer incorporated in the apparatus illustrated in FIG. 1.
Figure 6:
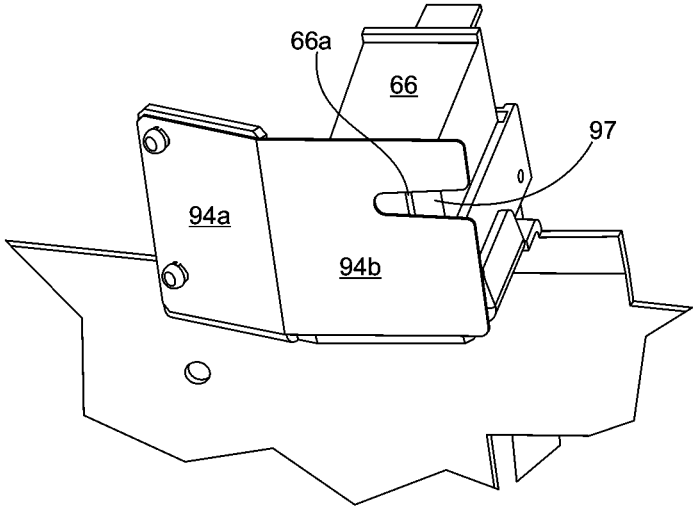
FIG. 6 is an enlarged, fragmentary perspective view of the inkjet printer incorporated in the apparatus illustrated in FIG. 1, taken from underneath the upper guide assembly.

With reference now to FIGS. 4-6, it will be seen that guide assembly 90 further includes an upper guide 94 disposed along the envelope path and aligned with the lower guide 92. The upper guide defines a first upper surface portion 94*a* inclined downwardly in a direction of conveyance to urge each advancing envelope downwardly against the upper surface 92*a* of the lower guide 92, whereby an upper surface of each advancing envelope transitions into an ink droplet deposition zone Z (FIG. 5) of height h, which may be on the order of from about 0.5 to about 1.5 mm.

As best seen in FIGS. 5 and 6, the upper guide further defines a substantially planar second upper surface portion 94*b* extending from the first upper surface portion 94*a*, the second surface portion being coplanar with the ink droplet deposition zone Z (FIG. 5. In embodiments, the upper guide 94 further defines an aperture 97 extending along and through at least a portion of the second upper surface portion 94*b*, the aperture being dimensioned and arranged to permit ink droplet deposition through the upper guide while an envelope is advanced. The aforementioned HP C6602A is especially preferred for the feed rates contemplated by the present disclosure, in that the special ink used therein dries within 0.5 seconds. Nonetheless, at high feed rates such as 160 cm/3 and beyond, the inventor herein has determined that incorporation of aperture 97 into upper guide 94 in alignment with the 1×M array of nozzles 98 (FIG. 6) ensures that the ink is not smeared across the surface of envelopes before the drying process is completed.

With particular reference to FIG. 5, it will be seen that inkjet cartridge retainer 68 incorporates a pair of sidewalls of which only one sidewall, indicated generally at 68*a*, is shown, as well as a pivotable lid 68*b* having integral protuberances 68*c* dimensioned and arranged for insertion into bores extending laterally through the sidewalls as sidewall 68*a*. This arrangement facilitates insertion and/or removal of the inkjet cartridge 66 into retainer 68. To further facilitate the insertion and removal process, the upper guide 94 is preferably fabricated from a material sufficiently resilient as to deform in a non-permanent manner when the inkjet cartridge is inserted or removed.

Figure 7:
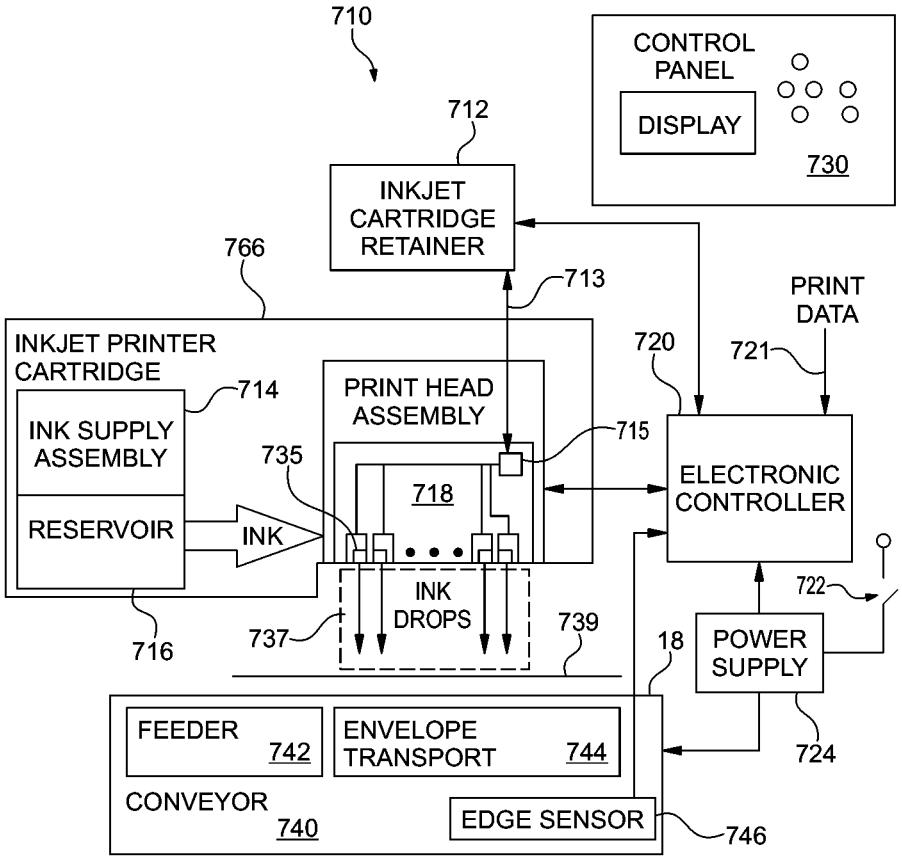
FIG. 7 is a block schematic diagram of an envelope opening device 710 with printing capability in accordance with embodiments consistent with the present disclosure.

FIG. 7 is a block schematic diagram of an envelope opening device 710 with printing capability in accordance with embodiments consistent with the present disclosure. The device 710 includes an inkjet cartridge retainer 712 having contacts (not shown) dimensioned and arranged for electrical coupling, via for example a ribbon cable indicated generally at 713, to contacts 715 of an inkjet printer cartridge 766 that comprises an ink supply assembly 714, a reservoir 716, and a print head assembly 718. The print head assembly, in an embodiment, is a thermal inkjet printer which includes a 1×M array of inkjet print nozzles indicated at 735, and resistors (not shown) operable by electronic controller 720 through control signals applied to contacts 715.

Device 710 further includes an on/off switch 722 for activating a power supply 724, control panel 730 including a display and buttons for operating the device 710, and a conveyor system 740 that includes a feeder 742 for serially feeding envelops from a stack, an envelope transport 744 for receiving the envelopes from the feeder, and an edge sensor 746. Power supply 724 provides power to the various electrical components of the envelope opening system 710.

Electronic controller 720 typically includes a processor, firmware, and other printer electronics for communicating with and controlling inkjet print head assembly 718, the contacts of cartridge retainer 712, and conveyor 740. Electronic controller 720 receives data 721 from a local memory utilized by a processor. As previously described, the data comprises a limited set of one or more blocks of alphanumeric strings comprising batch, date and time information.

In one embodiment, logic and drive circuitry are incorporated in a separate control board (not shown) operatively associated with the controller 720. In such embodiments, the electronic controller 720 and electronic control board operate together to control inkjet print head assembly 718 including timing control for ejection of ink drops from nozzles 735. As such, electronic controller 720 and the separate control board define a pattern of ejected ink drops which form characters and numbers on envelopes according to the specific print field and content options available to a user via the control panel 730. Timing control and, therefore, the pattern of ejected ink drops, is determined by the controller.

It will be recognized by those skilled in the art that changes or modifications may be made without departing from the broad inventive concepts of the invention.

What is claimed is:

1. An apparatus for opening and printing indicia upon envelopes containing contents, comprising:

an input bin dimensioned and arranged to receive and support a stack of envelopes;

a conveyor for forwardly conveying each envelope of the stack along an envelope path toward a discharge;

a cutter positioned along the envelope path operable to sever an edge of each envelope forwardly conveyed by the conveyor;

an inkjet cartridge retainer having electrical contacts for providing electrical connectivity to an inkjet cartridge defining a 1×M array of inkjet printing nozzles, the inkjet cartridge retainer being dimensioned and arranged to retain the inkjet cartridge in an orientation permitting ink droplets to be ejected onto an envelope being forwardly conveyed along the envelope path; and a controller electrically coupled to the electrical contacts of the inkjet cartridge retainer, the controller configured to activate the inkjet printing nozzles of a retained inkjet cartridge to deposit ink droplets according to a predetermined duty cycle able to cause printing, on an envelope conveyed at a first feed rate, a first indicium having a resolution of M dots per inch in a first direction transverse to the envelope path and a resolution of N dots per inch in a second direction parallel to the envelope path, where N is an integer less than or equal to M;

wherein the conveyor is configured to convey envelopes at a second feed rate greater than the first feed rate, whereby deposition of ink droplets onto a forwardly conveyed envelope results in printing the first indicium with a resolution of M dots per inch in the first direction and less than N dots per inch in the second direction.

2. The apparatus of claim 1, further including a lower guide disposed along the envelope path and defining a planar upper surface, the planar upper surface of the first guide being inclined upwardly from a plane of conveyance defined by the conveyor, wherein the lower guide is dimensioned and arranged to lift a region of an advancing envelope to accommodate deposition of ink droplets onto a target surface of the advancing envelope.

3. The apparatus of claim 2, wherein the second feed rate is greater than 80 centimeters/second (cm/s) and wherein the lower guide is a resilient member adapted to deflect by an amount effective to accommodate fed envelopes having thicknesses in a range of from about 0.25 mm to about 4.8 mm.

4. The apparatus of claim 2, further including an upper guide disposed along the envelope path and aligned with the lower guide, the upper guide defining a first surface portion inclined downwardly in a direction of conveyance to urge each advancing envelope downwardly against the planar upper surface of the lower guide, whereby an upper surface of each advancing envelope transitions into an ink droplet deposition zone.

5. The apparatus of claim 4, wherein the upper guide further defines a substantially planar second surface portion extending from the first surface portion, the second surface portion being coplanar with the ink droplet deposition zone.

6. The apparatus of claim 5, wherein the upper guide further defines an aperture extending along and through at least a portion of the second surface portion, the aperture being dimensioned and arranged to permit ink droplet deposition through the upper guide while an envelope is advanced.

7. The apparatus of claim 5, wherein upper guide is fabricated from a material sufficiently resilient as to accommodate insertion of an inkjet cartridge into registration with the inkjet cartridge retainer or removal therefrom.

8. The apparatus of claim 1, wherein the second feed rate is between from about 80 to about 165 cm/s.

9. The apparatus of claim 1, wherein the first feed rate is less than 80 cm/s and the second feed rate is at least 150 cm/s.

10. The apparatus of claim 1, wherein the first indicium is an alphanumeric character.

11. An apparatus for printing indicia upon envelopes containing contents, comprising:

an input bin dimensioned and arranged to receive and support a stack of envelopes;

a conveyor for forwardly conveying each envelope of the stack along an envelope path toward a discharge;

an inkjet cartridge retainer having electrical contacts for providing electrical connectivity to an inkjet cartridge defining a 1×M array of inkjet printing nozzles, the inkjet cartridge retainer being dimensioned and arranged to retain the inkjet cartridge in an orientation permitting ink droplets to be ejected onto an envelope being forwardly conveyed along the envelope path; and a controller electrically coupled to the electrical contacts of the inkjet cartridge retainer, the controller configured to activate the inkjet printing nozzles of a retained inkjet cartridge to deposit ink droplets according to a predetermined duty cycle able to cause printing, on an envelope conveyed at a first feed rate, a first indicium having a resolution of M dots per inch in a first direction transverse to the envelope path and a resolution of N dots per inch in a second direction parallel to the envelope path, where N is an integer less than or equal to M;

wherein the conveyor is configured to convey envelopes at a second feed rate greater than the first feed rate, whereby deposition of ink droplets onto a forwardly conveyed envelope results in printing the first indicium with a resolution of M dots per inch in the first direction and less than N dots per inch in the second direction.

12. The apparatus of claim 11, further including a lower guide disposed along the envelope path and defining a planar upper surface, the planar upper surface of the first guide being inclined upwardly from a plane of conveyance defined by the conveyor, wherein the lower guide is dimensioned and arranged to lift a region of an advancing envelope to accommodate deposition of ink droplets onto a target surface of the advancing envelope.

13. The apparatus of claim 12, wherein the lower guide is a resilient member adapted to deflect by an amount effective to accommodate fed envelopes having thicknesses in a range of from about 0.25 mm to about 4.8 mm.

14. The apparatus of claim 12, further including an upper guide disposed along the envelope path and aligned with the lower guide, the upper guide defining a first surface portion inclined downwardly in a direction of conveyance to urge each advancing envelope downwardly against the planar upper surface of the lower guide, whereby an upper surface of each advancing envelope transitions into an ink droplet deposition zone.

15. The apparatus of claim 14, wherein the upper guide further defines a substantially planar second surface portion extending from the first surface portion, the second surface portion being coplanar with the ink droplet deposition zone.

16. The apparatus of claim 15, wherein the upper guide further defines an aperture extending along and through at least a portion of the second surface portion, the aperture being dimensioned and arranged to permit ink droplet deposition through the upper guide while an envelope is advanced.

17. A method for processing envelopes containing contents, comprising the steps of:

providing a stack of envelopes containing contents;

conveying a first envelope from the stack along an envelope path, the conveying including transporting the envelope at a second feed rate greater than a first feed rate;

operating a controller to activate selected inkjet printing nozzles of a 1×M array of inkjet printing nozzles defined by an inkjet cartridge, the inkjet printing nozzles being activated according to a predetermined duty cycle able to cause printing, on an envelope conveyed at the first feed rate, a first indicium having a resolution of M dots per inch in a first direction transverse to the envelope path and a resolution of N dots per inch in a second direction parallel to the envelope path, where N is an integer less than or equal to M; and conveying the first envelope at the second feed rate during the operating whereby deposition of ink droplets onto a forwardly conveyed envelope results in printing the first indicium with a resolution of M dots per inch in the first direction and less than N dots per inch in the second direction.

18. The method of claim 17, further including a step of transporting the first envelope to a cutting element operable to cut a first edge of the first envelope.

19. The method of claim 17, wherein the operating comprises activating the inkjet printing nozzles while the inkjet cartridge is stationary.

20. The method of claim 17, wherein the second feed rate is a substantially constant velocity of from about 80 to about 165 cm/s.

21. The method of claim 20, wherein the second feed rate is from about 155 to about 165 cm/s.

22. The method of claim 17, further comprising repeating the operating to print multiple alphanumeric characters on the first envelope during the conveying.

* * * * *